US010337522B2

(12) United States Patent
An et al.

(10) Patent No.: US 10,337,522 B2
(45) Date of Patent: Jul. 2, 2019

(54) CENTRIFUGAL COMPRESSOR

(71) Applicant: MITSUBISHI HEAVY INDUSTRIES ENGINE & TURBOCHARGER, LTD., Sagamihara-shi, Kanagawa (JP)

(72) Inventors: Byeongil An, Tokyo (JP); Hiroshi Suzuki, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 506 days.

(21) Appl. No.: 14/902,139

(22) PCT Filed: Jul. 4, 2013

(86) PCT No.: PCT/JP2013/068374
§ 371 (c)(1),
(2) Date: Dec. 30, 2015

(87) PCT Pub. No.: WO2015/001644
PCT Pub. Date: Jan. 8, 2015

(65) Prior Publication Data

US 2016/0201693 A1 Jul. 14, 2016

(51) Int. Cl.
*F04D 29/44* (2006.01)
*F04D 29/42* (2006.01)
(Continued)

(52) U.S. Cl.
CPC ..... *F04D 29/4213* (2013.01); *F04D 17/10* (2013.01); *F04D 29/4206* (2013.01);
(Continued)

(58) Field of Classification Search
None
See application file for complete search history.

(56) References Cited

U.S. PATENT DOCUMENTS 6,447,241 B2 * 9/2002 Nakao ..... F04D 29/4213 415/1
2004/0009061 A1 * 1/2004 McDonald ..... F02C 7/04 415/151
(Continued)

FOREIGN PATENT DOCUMENTS

CN 1542290 A 11/2004
JP 2003-106299 A 4/2003
(Continued)

OTHER PUBLICATIONS

International Preliminary Report on Patentability and Written Opinion of the International Searching Authority (Forms PCT/IB/338, PCT/IB/373, PCT/IB/326 and PCT/ISA/237), dated Jan. 14, 2016, for International Application No. PCT/JP2013/068374, with an English translation of the Written Opinion.
(Continued)

*Primary Examiner* — Kayla Mccaffrey
(74) *Attorney, Agent, or Firm* — Birch Stewart Kolasch & Birch, LLP

(57) ABSTRACT

A centrifugal compressor includes: a compressor housing; an impeller wheel for compressing intake air, disposed inside the compressor housing; a parallel flow generating unit for rectifying the intake air flowing in via an intake port to be parallel to the direction of a rotation shaft; and a recirculation channel for returning a part of the intake air in an outer circumferential section of the impeller wheel to an upstream side of the impeller wheel. The parallel flow generating unit includes a parallel flow generating part including a plurality of guide vanes and a central intake-air flowing section which is a space surrounded by the parallel flow generating part. An intake-air outflow direction from an upstream opening is oriented toward the parallel flow generating part.

12 Claims, 8 Drawing Sheets

(51) Int. Cl.
*F04D 17/10* (2006.01)
*F04D 29/68* (2006.01)

(52) U.S. Cl.
CPC ..... *F04D 29/444* (2013.01); *F04D 29/685* (2013.01); *F05D 2220/40* (2013.01); *F05D 2250/51* (2013.01)

(56) References Cited

U.S. PATENT DOCUMENTS

| | | | | |
|---|---|---|---|---|
| 2005/0002782 | A1 | 1/2005 | Nikpour et al. | |
| 2009/0013689 | A1* | 1/2009 | Sumser ..... | F01D 9/026 60/605.1 |
| 2010/0143095 | A1 | 6/2010 | Higashimori et al. | |
| 2015/0192147 | A1 | 7/2015 | An et al. | |

FOREIGN PATENT DOCUMENTS

| | | | |
|---|---|---|---|
| JP | 2004-44576 | A | 2/2004 |
| JP | 2004-332733 | A | 11/2004 |
| JP | 2009-209694 | A | 11/2004 |
| JP | 20062650 | A | 1/2006 |
| JP | 2007-127108 | A | 5/2007 |
| JP | 2010-270641 | A | 12/2010 |
| JP | 2012-149619 | A | 8/2012 |
| JP | 2012-184751 | A | 9/2012 |
| JP | 2014/030248 | A | 2/2014 |

OTHER PUBLICATIONS

International Search Report (Forms PCT/ISA/210 and PCT/ISA/220), dated Aug. 6, 2013, for International Application No. PCT/JP2013/068374.

The Office Action effective August 28, 2017, issued to the corresponding CN Application No. 201380077809.8 with an English Translation.

Extended European Search Report issued in the corresponding EP Application No. 13888592.6, dated Jan. 25, 2017.

Chinese Office Action effective Dec. 5, 2016 issued in the corresponding Chinese Application No. 201300778098 with an English Translation.

Office Action dated Nov. 30, 2018 issued in corresponding European Application No. 13 888 529.6.

* cited by examiner

CENTRIFUGAL COMPRESSOR

TECHNICAL FIELD

The present invention relates to a centrifugal compressor including an impeller wheel rotated by a rotation shaft, and especially to a centrifugal compressor incorporated into an exhaust turbocharger.

BACKGROUND ART

For an engine used in automobiles and the like, an exhaust turbocharger is widely known. In an exhaust turbocharger, a turbine is rotated by exhaust-gas energy of the engine and a centrifugal compressor directly coupled to the turbine via a rotation shaft compresses intake air and supplies the engine with the intake air to improve the output of the engine.

In this case, depending on the rotation speed of various types of impeller wheel, there is a lower limit in the flow rate at which the pressure can be normally increased. If the flow rate is at the lower limit or below, vibration of the intake air occurs at an impeller upstream edge of the impeller wheel and the pressure may no longer increase.

The above phenomenon is referred to as surge.

On the other hand, there is also a limit in the maximum intake-air flow rate depending on the rotation speed of the impeller wheel, which is referred to as a choke phenomenon.

To compare the operation characteristics of a centrifugal compressor of such type, it is known to draw a graph as schematically illustrated in FIG. 10, showing a comparison chart of performance characteristics, where x-axis is the intake-air flow rate and y-axis is the pressure ratio.

With regard to the surge phenomenon, it is possible to improve the limit at which the surge phenomenon occurs by taking out a part of the intake air from the flow path at the downstream side of the impeller upstream edge of the impeller wheel to bypass the impeller wheel, returning the intake air to an intake channel at the upstream side of the impeller upstream edge, and increasing the apparent intake-air flow rate at the impeller upstream edge.

FIG. 10 is a comparison diagram illustrating a normal operation range surrounded by a surge line representing the minimum flow rate and a choking line representing the maximum flow rate, for each of a case where a normal compressor is further equipped with a recirculation flow channel, and a case where it is equipped with both of a recirculation flow channel and intake-flow guide vanes.

The effect to improve the surge phenomenon is most remarkable in the case where both of the recirculation flow channel and the intake-flow guide vanes are provided.

Accordingly, for a centrifugal compressor, it is desirable to achieve a wide flow-rate range between a choke flow rate and a surge flow rate, in which stable operation is enabled.

The disclosure of Patent Document 1 is to achieve such an object.

According to Patent Document 1, the centrifugal compressor includes guide vanes for generating a swirl flow in intake air at an upstream side of an impeller wheel, a swirl-flow generating unit for applying the swirl flow of the intake air to the impeller wheel, and a recirculation flow channel disposed on a housing of the centrifugal compressor. The recirculation flow channel recirculates a part of the intake air sucked into the impeller wheel to an intake channel at the upstream of the swirl-flow generating unit.

Such a technique will be described now with reference to FIG. 11.

An impeller wheel 101 of a centrifugal compressor 100 includes a plurality of vanes 104 that is rotatable inside a housing 102. The housing 102 has an inner wall disposed adjacently to radially-outer edges 104*a* of the vanes 104.

The intake port of the centrifugal compressor 100 includes an outer annular wall 107 forming an intake-air suction inlet 108 and an inner annular wall 109 extending inside the outer annular wall 107 to form an inducer 110.

A circulation gas channel 111 is formed between the outer annular wall 107 and the inner annular wall 109.

The circulation gas channel 111 communicates with a housing surface 105 via a downstream opening 113. The vanes 104 pass through the vicinity of the housing surface 105.

An upstream opening connects the circulation gas channel 111 and the inducer 110, i.e., the intake-air suction inlet 108.

Guide vanes 114 are disposed inside the inducer 110 of the upstream opening.

The guide vanes 114 generate a preceding swirl in the intake air flowing through the inducer 110.

With the above configuration, if the flow rate of the intake air flowing through the compressor is small, the direction of the intake air flowing through the circulation gas channel 111 reverses. Thus, the intake air flows through the downstream opening 113 from the impeller wheel 101 and through the circulation gas channel 111 in the upstream direction to be reintroduced into the intake-air suction inlet 108, thereby recirculating in the compressor.

In this way, the performance of the compressor is stabilized, and the surge margin and the choke flow rate of the compressor are both improved.

Further, Patent Document 1 discloses accommodating an intake-air guide vane device in the space inside the inner annular wall 109.

The intake-air guide vane device includes a plurality of guide vanes 114 extending in a radial direction between a nose cone 115 at the center and the inner annular wall 109.

The guide vanes 114 induce a preceding swirl so that the intake air flows in a direction that promotes the rotation of the impeller wheel 101. The preceding swirl improves the surge margin (surge limit) of the centrifugal compressor. (See the case with both of the recirculation channel and guide vanes in FIG. 10).

Further, according to Patent Document 2 (FIG. 4 in particular) a recirculation channel (cavity) extending in a direction of the flow path of the intake channel and along the circumferential direction is formed on a housing that surrounds the outer periphery of an intake channel.

The recirculation channel includes an air suction inlet that has an opening at an intermediate position of an impeller wheel, and an intake-air outlet that has an opening in the intake channel at the upstream side of the impeller wheel to open toward the center of the rotational axis of the impeller wheel.

In the housing between the leading edge (long blade) of the impeller wheel of the intake channel and the intake-air outlet, a plurality of inlet guide vanes are arranged at intervals in the circumferential direction.

The inlet guide vanes are disposed on the outer side, in the radial direction, of the outer circumferential edge of the leading edge of the impeller wheel, and inclined from the rotational axis.

The inclining direction of the inlet guide vanes is set so as to swirl the intake air having flowed through the intake channel in a direction opposite to the rotational direction of the impeller wheel.

If the flow rate of air at the inlet of the impeller wheel is small, incidence (difference between a relative flow angle and a vane angle) of the leading edge of the impeller increases, which may bring about separation of the air flow in the vicinity of the leading edge of the vanes and eventually surging of the centrifugal compressor.

In view of this, a swirl in the opposite direction to the rotational direction of the impeller wheel is applied to the flow of the intake air around the housing of the leading edge of the impeller so as to suppress generation of separation of air flow in the vicinity of the leading edge of the vanes, thereby improving the surge margin and widening the operation range of the centrifugal compressor.

CITATION LIST

Patent Literature

Patent Document 1: JP2004-332733A
Patent Document 2: JP2010-270641A

SUMMARY

Problems to be Solved

However, according to Patent Document 1, the nose cone 115 is disposed in a center space inside the inner annular wall in front of the impeller wheel 101.

It is clear that, with the nose cone 115, intake-air resistance increases with respect to the intake flow, and the choke flow rate decreases.

Further, more man hours are required to manufacture the nose cone 115 and to attach the guide vanes 114 to the nose cone 115 with high accuracy.

Accordingly, due to the guide vanes 114 for generating a swirl flow, air resistance may be increased by a cone-shaped member at the center for directing intake air to the guide vanes 114, and the choke flow rate may decrease. Further, if the inner annular wall 109 is extended to the upstream side to make the circulation gas channel 111 longer, the inner annular wall 109 may interfere with the inlet suction air and block the air directed to the guide vanes.

Further, in Patent Document 2 (FIG. 4 in particular), the outlet of intake air flowing out from the recirculation channel into the intake channel is configured such that intake air flows out toward the center of the rotational axis of the compressor wheel.

Thus, the intake air from the recirculation channel hits intake air having flown through the intake channel at an angle, which may bring about turbulence in the intake flow in the intake channel and increase the flow resistance of the intake air.

Further, since the inclining direction of the inlet guide vanes is set so as to swirl the intake air having flowed through the intake channel in a direction opposite to the rotational direction of the impeller wheel, turbulence may occur in the intake flow flowing into the impeller wheel and the loss of the intake flow may increase, which leads to surging, a decrease in the choke flow rate, and deterioration of the compression efficiency.

The present invention was made in view of the above problems, and an object of the present invention is to widen the operation range of a centrifugal compressor by improving the surge margin while reducing the flow resistance of intake air flowing through an intake channel to suppress a decrease in the choke flow rate.

Solution to the Problems

To achieve the above object, the present invention can provide a centrifugal compressor comprising: a housing including an intake port having an opening in a direction of a rotation shaft of the centrifugal compressor and an intake channel connecting to the intake port; an impeller wheel disposed inside the housing so as to be rotatable about the rotation shaft and configured to compress intake air flowing in via the intake port; a parallel flow generating unit disposed between the intake port and the impeller wheel and configured to rectify the intake air flowing in via the intake port to be parallel to the direction of the rotation shaft; and a recirculation channel through which an outer circumferential section of the impeller wheel communicates with a recirculation port disposed on the intake channel at an upstream side of the impeller wheel. The parallel flow generating unit includes a parallel flow generating part including a plurality of guide vanes arranged in a circumferential direction along an inner circumferential wall of the housing, the parallel flow generating part being configured to rectify the intake air flowing in via the intake port to be parallel to the direction of the rotation shaft by the guide vanes, and a central intake-air flowing section which is a space surrounded by the parallel flow generating part and which has an opening in the direction of the rotation shaft so that the intake air flowing in via the intake port flows through the opening. An intake-air outflow direction from the recirculation port is oriented in a direction toward the parallel flow generating part.

With the above configuration, intake air flowing in from the intake port and intake air from the recirculation port are rectified in the direction of the rotation shaft by the parallel flow generating part to be recirculated to the impeller wheel, and the central intake-air flowing section, which is a space surrounded by the parallel flow generating part, is provided to enhance the property of the intake flow to move linearly so as to reduce the intake-flow resistance, which makes it possible to increase the amount of intake air flowing into the impeller wheel, thereby improving the compression efficiency of the centrifugal compressor.

Thus, it is possible to improve the surge limit which may occur if the amount of intake air is small, and to suppress a decrease in the choke limit.

Further, preferably in the present invention, the intake-air outflow direction from the recirculation port is such a direction that the intake air intersects with the direction of the rotation shaft and that at least a part of the intake air intersects with upstream edges of the guide vanes as seen from a direction orthogonal to the direction of the rotation shaft.

With this configuration, the recirculated intake air flows securely along and in contact with the guide vanes of the parallel flow generating unit so as to improve the efficiency in rectifying the flow of the recirculation intake air and reduce the flow resistance, which makes it possible to increase the amount of intake air flowing into the impeller wheel.

Further, it is possible to prevent generation of turbulence due to collision with the intake air flowing through the central section of the intake channel to prevent an increase in the flow resistance of the intake air.

Further, preferably in the present invention, the recirculation port is disposed at an intermediate position, in the circumferential direction, between the guide vanes arranged at intervals in a circumferential direction of the intake channel.

With the above configuration, the recirculation port is disposed at an intermediate position between the guide vanes. Thus, the spouting intake air does not contact the guide surfaces of the guide vanes hard, and it is easier to form a flow flowing parallel to the rotation shaft, which makes it possible to reduce the flow resistance of the intake air at the guide vane part.

Further, preferably in the present invention, the central intake-air flowing section includes an annular guide portion connecting inner circumferential edges of the guide vanes in the circumferential direction.

With the above configuration, since the central section of the intake channel includes the annular guide portion having a space where the flow resistance of the intake air does not occur, it is possible to guide a large amount of intake air to the central section of the impeller wheel.

Further, the annular guide portion separates the intake air passing through the guide vanes on the radially outer side of the annular guide portion from the flow of the intake air passing through the inside of the annular guide portion, so that the intake air passing through the inside of the annular guide portion is not affected by the intake air passing through the guide vanes. Thus, it is possible to reduce and improve the flow resistance of the intake air, which increases the amount of intake air flowing into the impeller wheel and improves the surge.

Further, since the guide vanes are supported on both sides between the annular guide portion and the inner circumferential surface of the housing (the inner circumferential surface of the intake channel), the stiffness of the guide vanes is maintained.

Further, preferably in the present invention, a rim of the annular guide portion adjacent to the impeller wheel protrudes toward the impeller wheel from edges of the guide vanes adjacent to the impeller wheel.

With the above configuration, the rim of the annular guide portion adjacent to the impeller wheel protrudes toward the impeller wheel from the edges of the guide vanes adjacent to the impellers so as to be long. In this way, it is possible to reduce the turbulence of the intake air flowing inside the annular guide portion, and to stabilize the flow in the direction of the rotation shaft.

Further, although the intake air flowing along the guide vanes is rectified by the guide vanes, slight turbulence occurs immediately after the intake air passes through the guide vanes.

Thus, with the rim of the annular guide portion adjacent to the impeller wheel protruding toward the impeller wheel from the edges of the guide vanes adjacent to the impeller wheel, it is possible to reduce the interference of the intake air flowing through the guide vanes with the intake air flowing inside the annular guide portion.

Further, preferably in the present invention, the recirculation channel is partitioned in the circumferential direction of the intake channel by partition walls extending along the direction of the rotation shaft.

With the above configuration, the intake air having flowed into the recirculation channel from the outer circumferential section of the impeller wheel has inertia in the rotational direction of the impeller wheel.

Thus, the intake air is rectified to be a flow parallel to the rotation shaft by the partition walls inside the recirculation channel, and discharged into the intake channel from the recirculation port. In this way, it is possible to restrict the amount of intersection of the intake air with the guide vanes in the intake channel in the circumferential direction so as to reduce the flow resistance due to the guide vanes.

Further, reducing the amount of intersection with the guide vanes makes it possible to suppress noise that occurs upon rectification of the intake air.

Further, preferably in the present invention, the guide vanes are formed in a trapezoidal shape so that a length of the guide vanes along the direction of the rotation shaft decreases from an inner circumferential surface of the intake channel toward a rotational axis of the rotation shaft.

With the above configuration, the interference of the intake air discharged into the intake channel from the recirculation port with the intake air from the intake port decreases with a distance from the inner circumferential surface of the intake air toward the rotational axis.

Thus, with the length of the guide vanes along the direction of the rotation shaft being small, it is possible to reduce the flow resistance of the intake air.

Further, preferably in the present invention, edges of the guide vanes adjacent to the rotational axis are disposed on a side adjacent to the rotational axis with respect to an outer circumference of an upstream edge of the impeller wheel.

With the above configuration, the edges of the guide vanes adjacent to the axis are disposed closer to the center of the intake channel than the outer circumference of the upstream edge of the impeller wheel is, which makes it possible to guide the flow rectified by the guide vanes in the direction of the rotational axis to the upstream edges of the impeller wheel efficiently, and to reduce the flow resistance of the intake air.

Further, preferably in the present invention, the parallel flow generating unit includes an annular casing including the recirculation port and constituting a part of the recirculation channel, the annular guide portion, the guide vanes, and a connecting portion coupled to an upstream side of the recirculation port at one end and coupled to an upstream rim of the annular guide portion at another end. The annular casing, the annular guide portion, the guide vanes, and the connecting portion are formed integrally as a single piece.

With the above configuration, since the annular casing, the annular guide portion, the guide vanes, and the connection member are formed integrally as a single piece, it is possible to improve the stiffness of the members constituting the parallel flow generating unit.

Further, since the connection member prevents the intake air flowing through the intake channel from contacting the recirculation port directly, it is possible to increase the amount of intake air flowing out from the recirculation channel.

With the annular casing, the annular guide portion, the guide vanes, and the connection member formed integrally as a single piece, it is possible to reduce the production man hours, assembly accuracy, and the cost of the centrifugal compressor.

Further, preferably in the present invention, the housing is divided into an upstream housing including the intake channel and a downstream housing accommodating the impeller wheel. The centrifugal compressor further comprises: a first partition wall disposed on the upstream housing so as to define the intake channel and form a first recessed groove on a contact surface to the downstream housing at a radially outer side of the first partition wall, the first recessed groove having an annular shape centered at the rotation shaft and extending toward an upstream side of the intake channel; and a second partition wall which is a portion of the downstream housing facing the first recessed groove, the second partition wall defining the intake channel and forming a second recessed groove arranged in an annular shape centered at the rotation shaft, the second recessed groove extending toward a downstream side of the intake channel and having a communication hole communicating with the outer circumferential section of the impeller wheel, the second partition wall having a protrusion portion of an annular shape loosely fit into the first recessed groove and disposed so as to have a gap on a radially outer surface and a radially inner surface from the first recessed groove.

The guide vanes are disposed in the gap between the first partition wall and the second partition wall. The intake air flowing in via the communication hole flows through the second recessed groove, a gap between the first recessed groove and a radially outer side of the second partition wall, and a gap between a radially inner side of the second partition wall and a radially outer side of the first partition wall in this order, is rectified by the guide vanes to be parallel to the direction of the rotation shaft, and flows out to the intake channel toward the impeller wheel.

With the above configuration, since the guide vanes for rectifying the intake air from the recirculation channel are accommodated in the housing body, the cross-sectional area of the flow path of the central intake channel part is increased, which makes it possible to increase the choke flow rate by reducing the flow resistance of the intake air.

Advantageous Effects

According to the present invention, it is possible to provide a centrifugal compressor whereby the operation range of the centrifugal compressor is widened by improving the surge margin while reducing the flow resistance of intake air flowing through an intake channel to suppress a decrease in the choke flow rate.

DETAILED DESCRIPTION

Embodiments of the present invention will now be described in detail with reference to the accompanying drawings.

It is intended, however, that unless particularly specified, dimensions, materials, shapes, relative positions and the like of components described in the embodiments shall be interpreted as illustrative only and is not intended to limit the scope of the present invention.

Further, while a turbocharger is used in the following description as an example of a typical centrifugal compressor, the present invention may be applied to centrifugal compressors in general, such as an assist turbocharger equipped with an electric motor between a turbine rotor and an impeller wheel, an electric compressor without a turbine rotor, and a belt-driven supercharger.

(First Embodiment)

Figure 1:
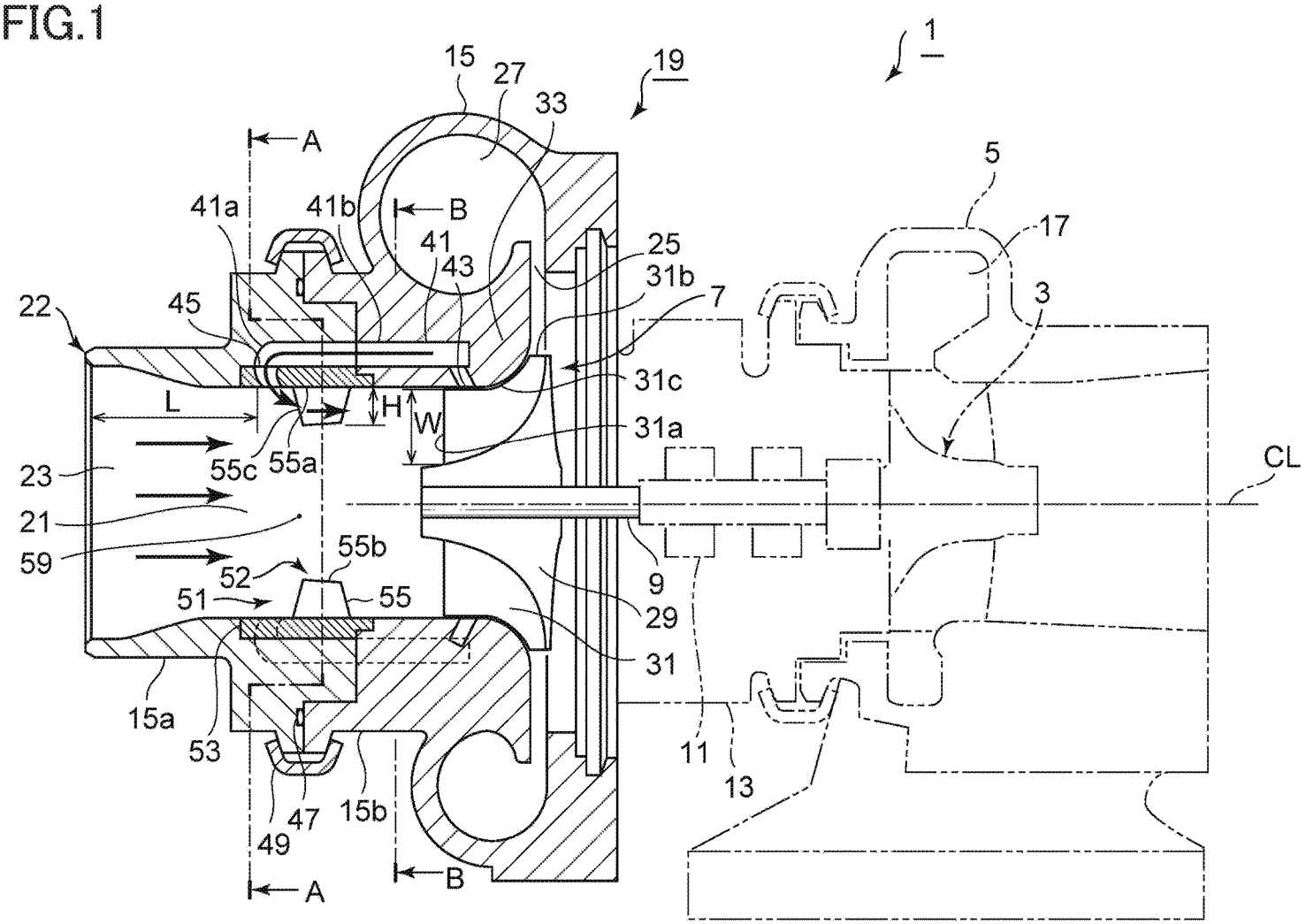
FIG. 1 is a partial cross-sectional view of a centrifugal compressor according to the first embodiment of the present invention, taken along the direction of a rotation shaft.

FIG. 1 is a partial cross-sectional view of a centrifugal compressor 19 according to the present invention, taken along the direction of a rotation shaft.

A turbocharger 1 including the centrifugal compressor 19 includes a turbine housing 5 accommodating a turbine rotor 3 driven by exhaust gas of an engine, an impeller wheel 7 for sucking and compressing air, a rotation shaft 9 for transmitting a rotational force of the turbine rotor 3 to the impeller wheel 7, a bearing housing 13 for rotatably supporting the rotation shaft 9 via a bearing 11, and a compressor housing 15 serving as a housing to accommodate the impeller wheel 7.

At the outer circumferential part of the turbine housing 5, a scroll channel 17 is formed in a scroll shape on the outer periphery of the turbine rotor 3. Exhaust gas from the engine flows toward the center of the rotation shaft 9 from the outer side in the radial direction, and then rotates the turbine rotor 3 while being discharged in the direction of the rotation shaft.

The compressor (centrifugal compressor) 19 according to the present invention is configured such that the impeller wheel 7 is rotatably supported in the compressor housing 15 centered at the rotational axis CL of the rotation shaft 9.

Intake air to be compressed by the impeller wheel 7 is directed by an intake channel 21 extending coaxially in the direction of the rotational axis CL.

An intake port 23 connecting to the intake channel 21 has an opening at an end portion at the upstream side of the intake channel 21.

The intake port 23 has a diameter increased in a tapered shape toward the end portion so that intake air can be introduced easily into the intake port 23.

On the outer side of the impeller wheel 7, a diffuser 25 is formed so as to extend in a direction orthogonal to the rotational axis CL.

An air channel 27 of a scroll shape is formed on the outer periphery of the diffuser 25. The air channel 27 of a scroll shape forms the outer circumferential part of the compressor housing 15.

The impeller wheel 7 includes a plurality of impellers 31 which is driven to rotate together with a hub 29 that is driven to rotate about the rotational axis CL. The hub 29 is mounted to the rotation shaft 9, and the plurality of impellers 31 is disposed on a radially outer surface of the hub 29.

The impellers 31 are driven to rotate so as to compress intake air that has been sucked in from the intake port 23 and has flowed through the intake channel 21. The shape of the impellers 31 is not particularly limited.

Each impeller 31 has a leading edge 31*a* which is an upstream edge portion, a trailing edge 31*b* which is a downstream edge portion, and an outer circumferential edge (outer circumferential part) 31*c* which is an edge portion at the radially outer side.

The outer circumferential edge 31*c* is a side edge covered by a shroud portion 33 of the compressor housing 15.

The outer circumferential edge 31*c* is disposed so as to pass the vicinity of the inner surface of the shroud portion 33.

The impeller wheel 7 of the compressor 19 is driven to rotate about the rotational axis CL by a rotational driving force of the turbine rotor 3.

Due to the rotation of the impeller wheel 7, ambient air is drawn in via the intake port 23 to flow through the impellers 31 of the impeller wheel 7, and then flows into the diffuser 25 disposed on the radially outer side after a dynamic pressure is mainly increased, thereby flowing through the air channel 27 of a scroll shape to be discharged, while a part of the dynamic pressure is converted into a static pressure to have the pressure increased.

The discharged intake air (supply air) is supplied as supply air for the engine.

Now, a recirculation channel 41 formed on the compressor housing 15 will be described.

The recirculation channel 41 is disposed so as to bring a downstream opening 43 of an annular shape into communication with an upstream opening 45. The downstream opening 43 is an opening on the compressor housing 15 and facing the outer circumferential edges 31*c* of the impellers 31. The upstream opening 45 is a recirculation port on the inner circumferential wall of the compressor housing 15, and disposed on the upstream side of the leading edges 31*a* of the impellers 31.

The intake air immediately after flowing into the impellers 31, or a part of the intake air whose pressure is being pressurized, is recirculated into the intake channel 21 at the upstream side of the impeller wheel 7 through the recirculation channel 41.

Further, the recirculation channel 41 includes a plurality of circulation holes 41*a*, 41*b* formed on a circumference centered at the rotational axis CL at the outer side of the intake channel 21 formed in a cylindrical shape.

The compressor housing 15 is divided into an upstream housing 15*a* and a downstream housing 15*b* at the position where the recirculation channel 41 is divided midway in the direction of the rotational axis CL so as to include the upstream housing 15*a* and the downstream housing 15*b*.

The contact surface between the upstream housing 15*a* and the downstream housing 15*b* forms a staircase-shaped contact surface so that the position is determined by socket-and-spigot fitting in the direction of the rotational axis CL and in the radial direction orthogonal to the direction of the rotational axis CL.

The contact surface between the upstream housing 15*a* and the downstream housing 15*b* is joined by a clamp ring 49 via a seal ring 47.

A fastening unit such as a bolt may be used for the joint.

Further, in the divided upstream housing 15*a* and downstream housing 15*b*, a plurality of the circulation holes 41*a*, 41*b* constituting the recirculation channel 41 on the circumference centered at the rotational axis CL is formed so as to extend along the direction of the rotational axis CL.

The recirculation channel 41 formed in the upstream housing 15*a* is closed at an intermediate position in the direction of the rotational axis CL of the upstream housing 15*a* so as to connect to the upstream opening 45 communicating with the intake channel 21 from the inner circumferential surface of the upstream housing 15*a*.

Figure 2:
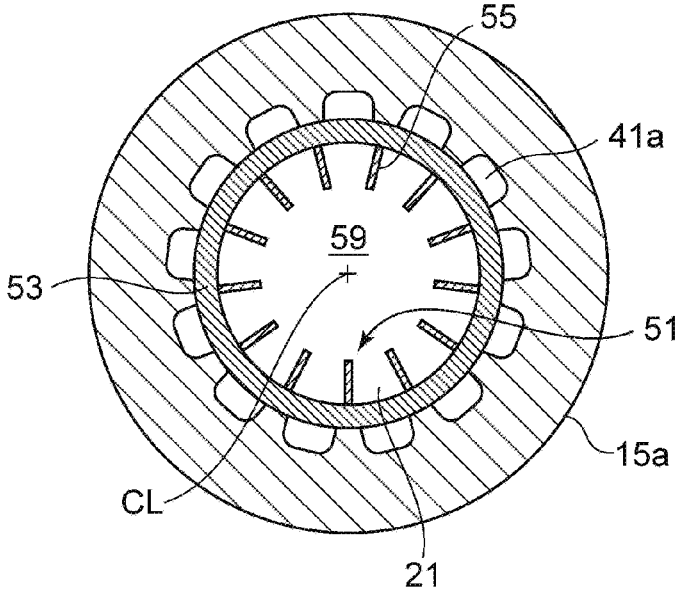
FIG. 2 is a cross-sectional view taken along line A-A from FIG. 1.

FIG. 2 illustrates an arrangement of the circulation holes 41*a* in the upstream housing 15*a* constituting the recirculation channel 41 in a cross-sectional view taken along a direction orthogonal to the rotational axis CL (A-A cross section of FIG. 1).

On the outer side of the intake channel 21, a plurality of, for instance thirteen, circulation holes 41*a* of a substantially ellipse shape are disposed on the same circumference centered at the rotational axis CL at regular intervals, so that the longitudinal direction of the ellipse shape is oriented in the circumferential direction.

The recirculation holes 41*a* of the upstream housing 15*a* are formed by providing as many uneven sections as the number of the circulation holes 41*a* in the circumferential direction on the inner circumferential wall of the upstream housing 15*a*, and fitting an outer tubular member 53 of the parallel flow generating unit 51 described below onto the inner circumferential wall of the uneven sections, so that the outer circumferential wall of the outer tubular member 53 and the uneven sections surround the recirculation holes 41*a*.

Figure 3:
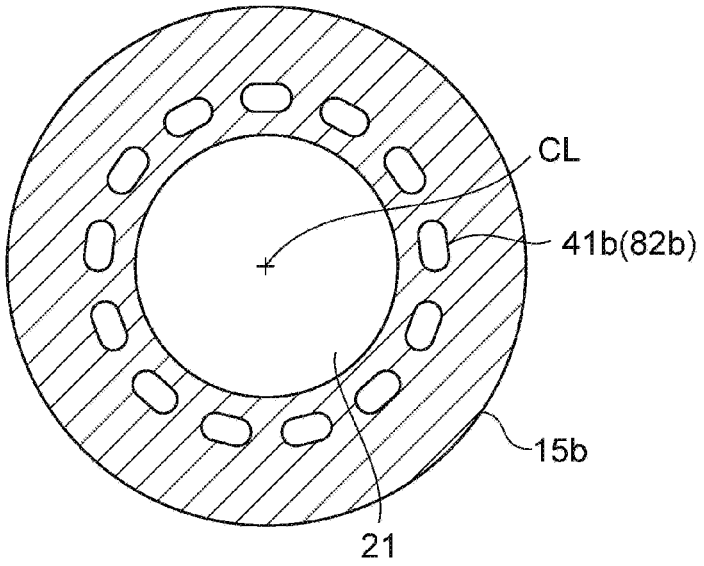
FIG. 3 is a cross-sectional view taken along line B-B from FIG. 1.

FIG. 3 illustrates an arrangement of the circulation holes 41*b* in the downstream housing 15*b* constituting the recirculation channel 41 in a cross-sectional view taken along a direction orthogonal to the rotational axis CL (B-B cross section of FIG. 1).

On the outer side of the intake channel 21 and on the same circumference as the circulation holes 41*a* formed on the upstream housing 15*a*, thirteen circulation holes 41*b* of an ellipse shape are formed at the same interval and at the same phase in the circumferential direction.

As described above, the recirculation channel 41 is halved into the section of the upstream housing 15*a* and the section of the downstream housing 15*b*. Thus, it is possible to process the circulation holes 41*a*, 41*b* of the recirculation channel 41 from the division surfaces of the upstream housing 15*a* and the downstream housing 15*b*, respectively.

In this way, formation of the recirculation channel 41 is facilitated, which makes it possible to reduce the man hours.

The positions of the circulation holes 41*b* of the downstream housing 15*b* and the circulation holes 41*a* of the upstream housing 15*a* are formed so as to match in both of the radial direction and the circumferential direction, so that the circulation holes 41*a*, 41*b* merge by joining the respective housings.

The recirculation channel 41 has the following function.

If the amount of intake air flowing through the compressor 19 is appropriate, the intake air to flow through the recirculation channel 41 is taken in from the intake port 23 and flows from the upstream opening 45 toward the downstream opening 43, and then enters the outer circumferential edges 31*c* of the impellers 31 from the downstream opening 43.

In contrast, if the amount of intake air flowing through the compressor 19 decreases to such a low flow rate that brings about surging, the intake air flows through the recirculation channel 41 in the reverse direction. That is, the intake air flows toward the upstream opening 45 from the downstream opening 43 to be reintroduced in to the intake channel 21.

The intake air flows in the reverse direction, because the intake air is compressed at an intermediate section of the compressor and the intake pressure at the downstream opening 43 becomes higher than the intake pressure at the upstream opening 45.

In this way, the apparent amount of intake air flowing into the leading edges 31*a* of the impellers 31 increases, which makes it possible to reduce the surge flow rate at which surging occurs.

As described above, it is possible to reduce the surge flow rate by providing the recirculation channel 41. Since the impeller wheel 7 generates noise of a frequency determined by the number and the rotation speed of the impellers 31, the length of the recirculation channel 41 and the number of circulation holes 41*a*, 41*b* (thirteen in the present embodiment) are set to be in a frequency range that does not cause resonance with the frequency of the noise generated by the impeller wheel 7.

Next, the parallel flow generating unit 51 will be described with reference to FIGS. 1 and 4.

As illustrated in FIG. 1, the parallel flow generating unit 51 is disposed inside the intake channel 21 of the upstream housing 15*a* and between the upstream opening 45 and the impeller wheel 7 so as to rectify the recirculation intake air flowing out to the intake channel 21 from the upstream opening 45 and the intake air flowing in from the intake port 23 to be parallel to the rotation shaft 9.

The parallel flow generating unit 51 includes a parallel flow generating part 52 and a central intake-air flowing section 59.

The parallel flow generating part 52 includes the outer tubular member 53 fitting with the inner circumferential wall of the upstream housing 15*a* and a plurality of guide vanes 55 disposed at regular intervals in the circumferential direction along the inner circumferential wall of the outer tubular member 53.

Each guide vane 55 includes a plate member of a thin plate shape, and has a substantially trapezoidal shape at the side adjacent to the rotational axis CL.

Figure 4:
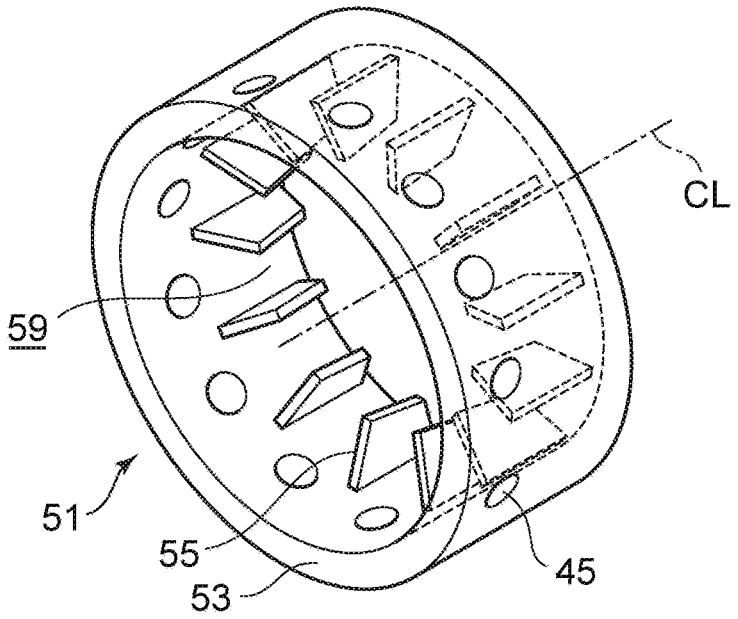
FIG. 4 is a perspective view of a parallel flow generating unit according to the first embodiment of the present invention.

As illustrated in FIG. 4, the mounting orientation of the guide vane 55 is as follows. A long side 55*a* of the substantially trapezoidal shape is fixed to the inner wall surface of the outer tubular member 53, and a short side 55*b* extends toward the rotational axis CL to an intermediate section of the intake channel 21.

The guide vane 55 is arranged such that a flat surface (guide surface) of the plate member is parallel to the direction of the rotational axis CL.

The central intake-air flowing section 59 is a space formed at a central section of the intake channel 21, formed by short sides of the plurality of guide vanes 55 centered at the rotational axis CL.

The central intake-air flowing section 59 has a great effect to suppress a decrease in the choke flow rate, because the intake air sucked into the central intake-air flowing section 59 reaches the impeller wheel 7 directly and thus the flow resistance of the intake air is small.

Further, to fix the guide vanes 55 securely to the outer tubular member 53, each guide vane 55 may have a thickness in the circumferential direction that is larger at the long side and thinner at the short side so as to improve the strength.

Furthermore, as illustrated in the perspective view of the parallel flow generating unit 51 in FIG. 4, the guide vanes 55 are arranged on the inner circumferential wall of the outer tubular member 53 at regular intervals in the circumferential direction.

The upstream opening 45 disposed on the outer tubular member 53 is at a position to face the intermediate position between the adjacent guide vanes 55.

Further, the upstream opening 45 is disposed so that the intake air flowing out to the intake channel 21 from the upstream opening 45 flows out in such a direction that the intake air intersects with the direction of the rotation shaft and at least a part of the intake air intersects with upstream edges 55*c* of the guide vanes 55.

In this way, the contact between the recirculated intake air and the guide vanes 55 of the parallel flow generating unit 51 is reduced as much as possible to reduce the flow resistance of the intake air due to the guide vanes 55 and to increase the amount of intake air flowing into the impeller wheel 7, which makes it possible to reduce the surge flow rate.

Further, the height H of the guide vanes 55 (see FIG. 1) is set such that a position (height H) of the short side 55*b* from the inner circumferential wall of the outer tubular member 53 is at a side adjacent to the rotational axis CL with respect to the outer periphery of the leading edges 31*a* of the impellers 31.

With regard to the intake air flowing through the intake channel 21, turbulence tends to occur more in the vicinity of the wall surface of the intake channel than at the center section of the intake channel 21, due to the flow resistance caused by the wall surface.

Thus, the height H of the guide vanes 55 needs to be positioned closer to the rotational axis CL than the outer circumferential edges of the upstream edges of the impellers 31 are.

In this way, it is possible to prevent the intake air flowing into the intake channel 21 from the upstream opening 45 from generating turbulence in the intake air flowing through the intake channel 21. Also, it is possible to increase the intake amount of the impellers 31 by rectifying the intake air (to be parallel to the direction of the rotation shaft) introduced into the outer circumferential edges 31*c* of the impellers 31.

Further, the height H of the guide vanes 55 is smaller than the height W (see FIG. 1) of the leading edges 31*a* of the impellers 31 in order to increase the cross-sectional area of the flow path of the intake air at the central intake-air flowing section 59 as much as possible.

In this way, the intake air flowing out to the intake channel 21 from the upstream opening 45 is rectified by the guide vanes 55.

In addition, the height H of the guide vanes 55 is configured to be smaller than the height W of the leading edges 31*a* of the impellers 31 to increase the cross-sectional area of the flow path of the intake air at the central intake-air flowing section 59, which makes it possible to achieve an effect to reduce the flow resistance of the intake air flowing through the central intake-air flowing section 59 and to suppress a decrease in the choke flow rate.

The parallel flow generating unit 51 is formed as a separate member from the upstream housing 15*a*, and mounted to the upstream housing 15*a* by fitting the outer tubular member 53 to the inner wall surface of the upstream housing 15*a* by fitting such as press fitting.

As illustrated in FIG. 1, in the mounted state, the inner wall surface of the outer tubular member 53 forms a flush surface with the inner circumferential wall surface of the intake channel 21 formed in the downstream housing 15*b* and with the inner circumferential wall surface of the intake channel 21 formed in the upstream housing 15*a*.

Thus, with such configuration, it is possible to provide the intake channel 21 with a smooth wall surface.

Further, as illustrated in FIG. 1, if the parallel flow generating unit 51 is mounted to the inner circumferential part of the upstream housing 15*a*, the outer circumferential wall of the outer tubular member 53 forms an inner circumferential part (see FIG. 2) of the circulation hole 41*a* formed inside the upstream housing 15*a*.

Further, the upstream housing 15*a*, the downstream housing 15*b*, and the parallel flow generating unit 51 are formed as separate members, and the compressor housing 15 is fabricated by assembling the above members.

In this way, manufacture is facilitated because the inside of the compressor housing can be processed via the contact surface between the upstream housing 15*a* and the downstream housing 15*b*.

Since the compressor housing 15 is manufactured by assembling, it is easy to change the cross-sectional shape and length of the circulation holes 41*a*, 41*b* constituting the recirculation channel 41, and the number and height H of the guide vanes 55, which makes it possible to change the operation range of the compressor 19 easily.

Further, since the parallel flow generating unit 51 is disposed on the intake side of the turbocharger 1, the temperature of the intake air that the parallel flow generating unit 51 contacts is low, which makes it possible to reduce the cost even further by forming the parallel flow generating unit 51 as a single piece from aluminum, resin, or the like.

According to the above embodiment, directions of the intake air from the recirculation channel 41 and the intake air from the intake port 23 are rectified to be in a direction of the rotational axis CL at the parallel flow generating part 52, and the central intake-air flowing section 59, which is a space surrounded by the parallel flow generating part, is provided to enhance the property of the intake flow to move linearly in the direction of the rotational axis CL. As a result, it is possible to prevent turbulence in the intake flow immediately before the impeller wheel 7.

As a result, the flow resistance of the intake air introduced into the impeller wheel 7 decreases and the amount of intake air increases, which improves the compression efficiency of the compressor (centrifugal compressor) 19.

Accordingly, in addition to the improvement of the surge margin (surge occurrence limit) achieved by the recirculation channel 41, the recirculation intake air flowing into the intake channel 21 from the recirculation channel 41 and a part of intake air from the intake port 23 are rectified by the guide vanes 55 to be parallel to the rotation shaft 9. In this way, the surge flow rate (minimum flow rate) further decreases and the surge margin improves.

Further, the central intake-air flowing section 59 inside the guide vanes 55 enhances the property of the intake flow to move linearly in the direction of the rotational axis CL, which makes it possible to reduce the flow resistance against the intake air and to suppress a decrease in the choke flow rate. That is, it is possible to improve the supercharging performance of the turbocharger 1.

(Second Embodiment)

The second embodiment will be described with reference to FIGS. 5 and 6.

The second embodiment is different from the first embodiment only in that an inner tubular member 65 serving as an annular guide portion is additionally provided to the central intake-air flowing section of the parallel flow generating unit 61.

Thus, the same component is indicated by the same reference numeral and not described in detail.

Figure 5:
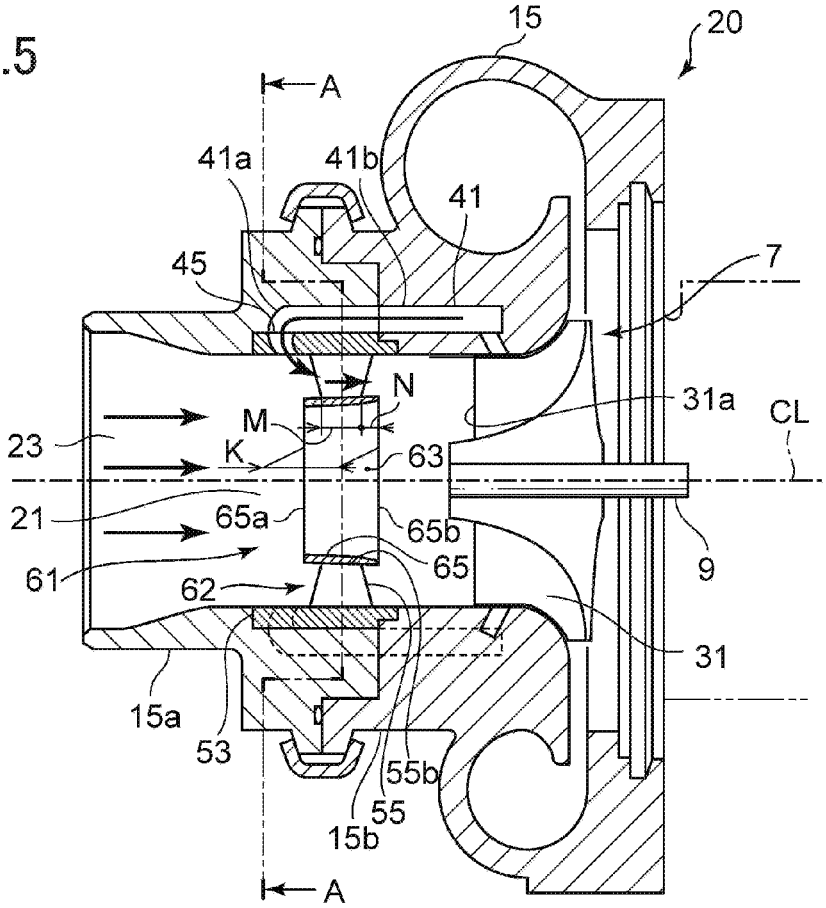
FIG. 5 is a partial cross-sectional view of a centrifugal compressor according to the second embodiment of the present invention, taken along the direction of a rotation shaft.

As illustrated in FIG. 5, the parallel flow generating unit 61 of the compressor 20 is disposed inside the intake channel 21 of the upstream housing 15*a* and between the upstream opening 45 and the impeller wheel 7 so as to rectify the recirculation intake air flowing out to the intake channel 21 from the upstream opening 45 and the intake air flowing in from the intake port 23 to be parallel to the rotational axis CL.

The parallel flow generating unit 61 includes a parallel flow generating part 62 and a central intake-air flowing section 63.

Figure 6:
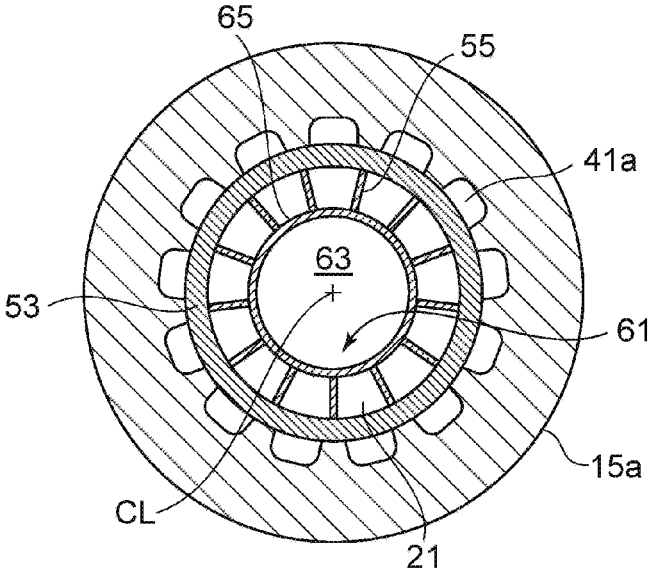
FIG. 6 is a cross-sectional view taken along line A-A from FIG. 5.

Further, as in the A-A cross section of FIG. 5 illustrated in FIG. 6, the parallel flow generating part 62 includes the outer tubular member 53 fitting with the inner circumferential wall of the upstream housing 15*a*, a plurality of guide vanes 55 disposed at regular intervals in the circumferential direction along the inner circumferential wall of the outer tubular member 53, and an inner tubular member 65 serving as an annular guide portion disposed so as to have a structure that connects the short sides 55*b* (see FIG. 1) in the circumferential direction of the intake channel 21, the short sides 55*b* being edges of the guide vanes 55 adjacent to the rotational axis CL.

Each guide vane 55 includes a plate member of a thin plate shape, and has a substantially trapezoidal shape including the long side 55*a* (see FIG. 1) fixed to the inner circumferential wall of the outer tubular member 53 and the short side 55*b* adjacent to the rotational axis CL.

The parallel flow generating part 62 includes the guide vanes 55 and the inner tubular member 65.

The interior space of the inner tubular member 65 is a central intake-air flowing section 63 through which the intake air flowing in from the intake port 23 flows in the direction of the rotational axis CL toward the impeller wheel 7 rotating about the rotational axis CL.

The height H of the guide vanes 55, the relative positional relationship between the guide vanes 55 and the upstream opening 45, the mounting of the guide vanes 55 to the outer tubular member 53, and the like are similar to those in the first embodiment, and thus not described here in detail.

The length K, in the direction of the rotational axis CL, of the inner tubular member 65 is longer than the length M of the short sides 55*b* of the guide vanes 55, and both of an upstream opening rim 65*a* and a downstream opening rim 65*b* protrude from the short sides 55*b* of the guide vanes 55 in the direction of the rotational axis CL.

In the present embodiment, the length K of the inner tubular member 65 is longer than the long sides 55*a* of the guide vanes 55.

The downstream opening rim 65*b* of the inner tubular member 65 forms a space that has an increasing diameter so that the cross sectional area of the central intake-air flowing section 63 increases toward the impeller wheel 7.

With the above configuration, the upstream opening rim 65*a* of the inner tubular member 65 protrudes toward the upstream side from the short sides 55*b*, which suppresses turbulence of the flow of the intake air flowing through the central intake-air flowing section 63 due to the recirculation intake air flowing out from the upstream opening 45.

Also, the turbulence of the flow of the intake air flowing through the central intake-air flowing section 63 is restricted by setting a protrusion amount N, which is an amount of downstream protrusion of the downstream opening rim 65*b* from the edges of the short sides 55*b* of the guide vanes 55, adjacent to the impeller wheel 7.

In the present embodiment, a good result is obtained by a protrusion amount N satisfying $N \geq M/3$.

Although intake air flowing along the guide vanes is rectified by the guide vanes 55, slight turbulence occurs immediately after the intake air passes through the guide vanes.

Thus, with the downstream opening rim 65*b* of the inner tubular member 65 protruding toward the impeller wheel 7 from the short sides 55*b* of the guide vanes 55, it is possible to suppress interference of the intake air having flown through the guide vanes 55 with the intake air flowing out from the central intake-air flowing section 63.

Suppression of the turbulence in the intake air makes it possible to reduce and improve the flow resistance of the intake air. As a result, the amount of intake air flowing into the impeller wheel increases, and thereby the surge improves.

The guide vanes 55 may be supported at both ends between the outer tubular member 53 and the inner tubular member 65, which improves the stiffness of the guide vanes 55.

According to the above second embodiment, in addition to the improvement of the surge margin (surge occurrence limit) achieved by the recirculation channel 41, the intake air flowing into the intake channel 21 from the recirculation channel 41 is rectified by the guide vanes 55 to be parallel to the rotation shaft 9. In this way, the surge flow rate (minimum flow rate) further decreases and the surge margin improves.

Further, the central intake-air flowing section 63 inside the inner tubular member 65 makes it possible to reduce the flow resistance against the intake air and thus to suppress a decrease in the choke flow rate.

That is, it is possible to improve the supercharging performance of the turbocharger 1.

Further, since the parallel flow generating unit 61 is disposed on the intake side of the turbocharger 1, the temperature of the intake air to contact the parallel flow generating unit 61 is low, which makes it possible to reduce the cost further by forming the parallel flow generating unit 61 as a single piece from aluminum, resin, or the like.

(Third Embodiment)

Next, the third embodiment will be described with reference to FIG. 7.

The third embodiment is different from the second embodiment only in that the parallel flow generating unit 71 has a different configuration.

Thus, the same component is indicated by the same reference numeral and not described in detail.

Figure 7:
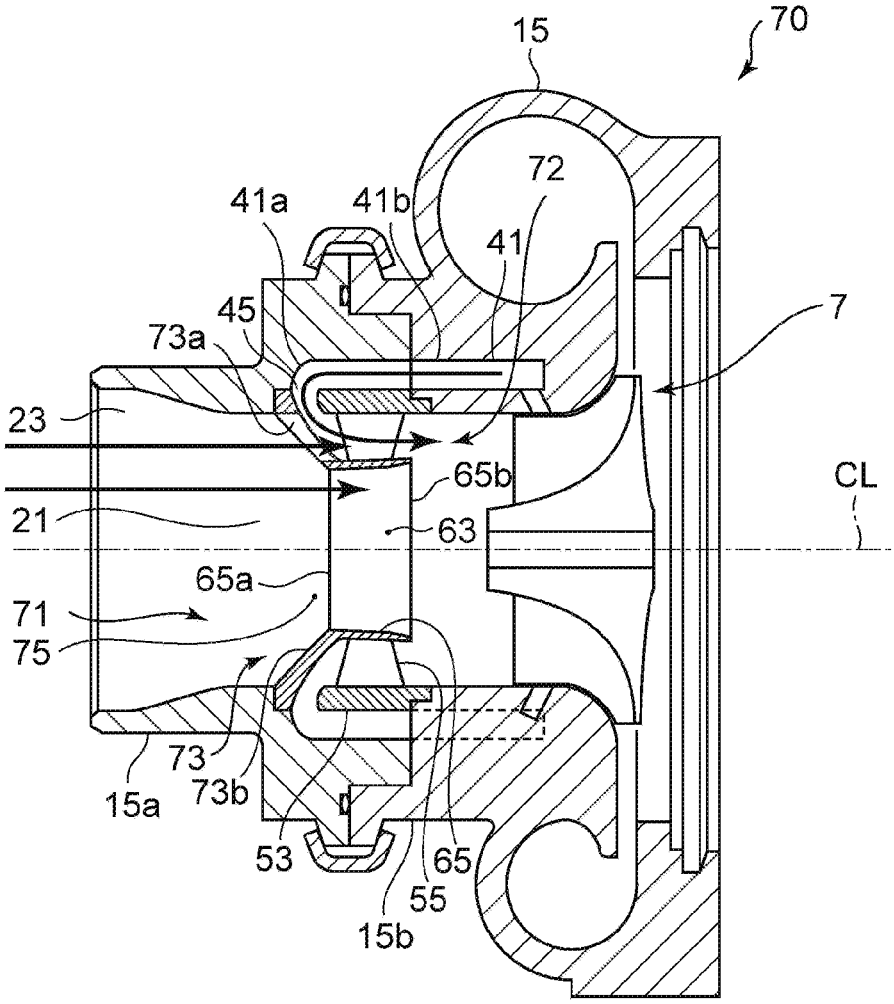
FIG. 7 is a partial cross-sectional view of a centrifugal compressor according to the third embodiment of the present invention, taken along the direction of a rotation shaft.

As illustrated in FIG. 7, the parallel flow generating unit 71 of the compressor 70 is disposed inside the intake channel 21 of the upstream housing 15*a* and between the upstream opening 45 and the impeller wheel 7 so as to rectify the recirculation intake air flowing out to the intake channel 21 from the upstream opening 45 and the intake air flowing in from the intake port 23 to be parallel to the rotational axis CL.

The parallel flow generating unit 71 includes a parallel flow generating part 72 and a central intake-air flowing section 63.

The parallel flow generating part 72 includes the outer tubular member 53 fitting with the inner circumferential wall of the upstream housing 15*a*, a plurality of guide vanes 55 disposed at regular intervals in the circumferential direction along the inner circumferential wall of the outer tubular member 53, an inner tubular member 65 serving as an annular guide portion disposed so as to have a structure that connects the short sides 55*b* (see FIG. 1) being the inner circumferential edges of the guide vanes 55 in the circumferential direction of the intake channel 21, and a connection member 73 connecting an upstream side of the upstream opening 45 serving as a recirculation port of the outer tubular member 53 and an upstream end 75*a* of the inner tubular member 65.

The parallel flow generating part 72 includes the guide vanes 55, the inner tubular member 65, and the connection member 73.

The interior space of the inner tubular member 65 is a central intake-air flowing section 63 through which the intake air flowing in from the intake port 23 flows in the direction of the rotational axis CL toward the impeller wheel 7 rotating about the rotational axis CL.

The connection member 73 has an exterior appearance of a truncated conical shape, in which the upstream side of the intake channel 21 has a large diameter and the downstream side of the same has a small diameter, both ends in the direction of the rotational axis CL are open, and an interior space 75 is a space of a truncated conical shape similar to the exterior appearance.

The interior space 75 of a truncated conical shape of the connection member 73 connects smoothly to the central intake-air flowing section 63 of the inner tubular member 65.

Further, a plurality of through holes 73*a* is disposed on the connection member 73 so as to penetrate in the direction of the rotational axis CL through a connecting portion connecting the large diameter and the small diameter.

The through holes 73*a* are arranged at regular intervals in the circumferential direction, centered at the rotational axis CL. Also, the connecting portions 73*b* partitioning between the through holes 73*a* are arranged at the substantially same phase in the circumferential direction as the guide vanes 55.

The width in the circumferential direction of the connecting portions 73*b* is larger than the thickness of the guide vanes 55.

The shape and relative positional mounting relationship of each of the outer tubular member 53, the guide vanes 55, and the inner tubular member 65 are similar to those in the second embodiment, and thus not described here in detail.

With the above configuration, the intake air flowing in from the intake port 23 of the upstream housing 15*a* and the recirculation intake air from the upstream opening 45 flow through the through holes 73*a* of the connection member 73 while being rectified by the guide vanes 55 toward the impeller wheel 7.

Further, since the recirculation intake air from the upstream opening 45 is drawn out by the intake air flowing through the through holes 73*a*, the amount of recirculation intake air increases, which makes it possible to improve the surge margin with the recirculation channel 41.

On the other hand, the amount of intake air flowing through the central intake-air flowing section 63 of the inner tubular member 65 is maintained, which makes it possible to suppress a decrease in the choke flow rate.

(Fourth Embodiment)

The fourth embodiment will be described with reference to FIG. 8.

The fourth embodiment is different from the first embodiment only in that the parallel flow generating unit 81 has a different configuration.

Thus, the same component is indicated by the same reference numeral and not described here in detail.

Figure 8:
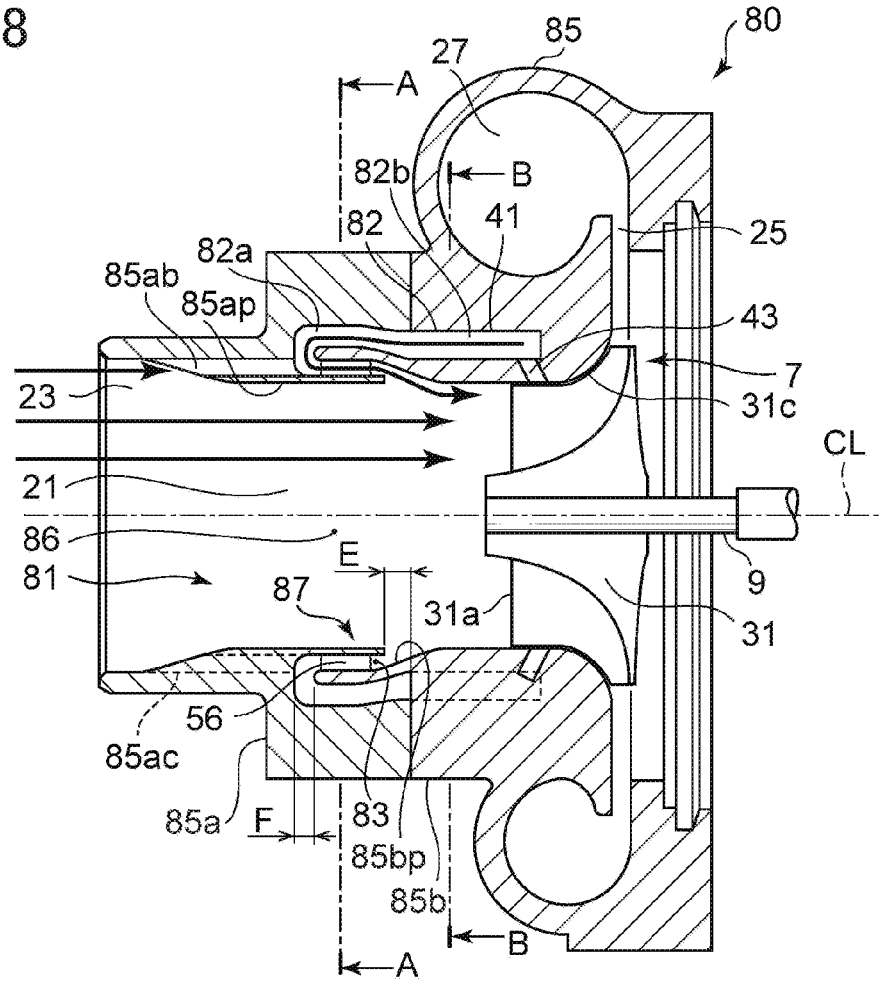
FIG. 8 is a partial cross-sectional view of a centrifugal compressor according to the fourth embodiment of the present invention, taken along the direction of a rotation shaft.

FIG. 8 is a partial cross-sectional view of a compressor (centrifugal compressor) 80 according to the present invention, taken along the direction of a rotation shaft.

The compressor 80 according to the present invention is configured such that the impeller wheel 7 is rotatably supported in the compressor housing 85 centered at the rotational axis CL of the rotation shaft 9.

Intake air to be compressed by the impeller wheel 7 is directed toward an engine by an air channel 27 extending coaxially in the direction of the rotational axis CL.

An intake port 23 connecting to the intake channel 21 has an opening on an end portion at the upstream side of the intake channel 21.

The intake port 23 has a diameter increased in a tapered shape toward the end portion so that intake air can be introduced easily into the intake port 23.

On the outer side of the impeller wheel 7, a diffuser 25 is formed so as to extend in a direction orthogonal to the rotational axis CL.

An air channel 27 of a scroll shape is formed on the outer periphery of the diffuser 25. The air channel 27 of a scroll shape is formed by the outer circumferential part of the compressor housing 85.

Due to the rotation of the impeller wheel 7, ambient air is drawn in via the intake port 23 to flow through the impellers 31 of the impeller wheel 7, and then flows into the diffuser 25 disposed on the radially outer side after a dynamic pressure is mainly increased, thereby flowing through the air channel 27 of a scroll shape to be discharged, while a part of the dynamic pressure is converted into a static pressure to have the pressure increased.

The discharged air is supplied as supply air for the engine.

Now, a recirculation channel 82 formed on the compressor housing 85 will be described.

The compressor housing 85 is divided into an upstream housing 85*a* and a downstream housing 85*b* at the position where the recirculation channel 82 is divided midway in the direction of the rotational axis CL so as to include the upstream housing 85*a* and the downstream housing 85*b*.

The recirculation channel 82 is disposed so as to bring a downstream opening 43 of an annular shape into communication with an upstream opening 83. The downstream opening 43 is a communication hole with an opening on the downstream housing 85*b*, which faces the outer circumferential edges 31*c* of the impellers 31. The upstream opening 83 is an opening on the inner circumferential wall of the upstream compressor housing 85*a*, which is disposed on the upstream side of the leading edges 31*a* of the impellers 31.

The intake air immediately after flowing into the impellers 31, or a part of the intake air whose pressure is being pressurized, is recirculated into the intake channel 21 at the upstream side of the impeller wheel 7 through the recirculation channel 82.

Further, in the divided upstream housing 85*a* and downstream housing 85*b*, the first recessed groove 82*a* constituting a recirculation channel 82 on the outer circumference of the intake channel 21, an upstream opening 83, and a circulation hole 82*b* serving as the second recessed groove form a flow path along the direction of the rotational axis CL and centered at the rotational axis CL.

The first recessed groove 82*a* formed on the upstream housing 85*a* to constitute the recirculation channel 82 is a recessed groove extending along the rotational axis CL toward the intake port 23 from the contact surface to the downstream housing 85*b* and formed in annular shape closed at a midway position.

An upstream partition wall portion 85*ap* serving as the first partition wall partitioning the intake channel 21 from the first groove 82*a* of an annular shape extends to a position E on the upstream side of the contact surface to the downstream housing 85*b*.

On the other hand, the recirculation channel 82 formed on the downstream housing 85*b* includes the circulation hole 82*b* serving as the second recessed groove communicating with the downstream opening 43 of an annular shape from the contact surface to the upstream housing 85*a* at a position facing the first annular groove 82*a* of an annular shape.

As in the B-B cross section of FIG. 8 illustrated in FIG. 3, thirteen circulation holes 82*b* of the substantially same ellipse shape are formed at the same interval in the circumferential direction on the outer circumference of the intake channel 21, centered at the rotational axis CL.

Then, the downstream partition wall portion serving as the second partition wall separating the intake channel 21 from the circulation holes 82*b* of the ellipse shape includes a protrusion portion 85*bp* of an annular shape that loosely fits into the first recessed groove 82*a* of an annular shape of the upstream housing 85*a*.

Loosely fitting means that there is an adequate space (flow cross-sectional area) for the recirculation intake air to flow through, between the wall surface forming the first recessed groove 82*a* and both of the outer circumferential surface and the inner circumferential surface of the protrusion portion 85*bp* of an annular shape.

The protrusion portion 85*bp* of an annular shape is formed so as to be positioned at an intermediate part, in the radial direction, of the first recessed groove 82*a* of an annular shape, centered at the rotational axis CL.

Further, the protrusion portion 85*bp* of an annular shape has a diameter that increases in a tapered shape from the upstream side of the leading edges 31*a* of the impellers 31 toward a position E of the upstream partition wall portion 85*ap*, and is formed into a cylindrical shape extending toward the further upstream side of the position E.

There is a gap F between an upstream tip end of the protrusion portion 85*bp* and an upstream tip end (closed portion) of the first recessed groove 82*a* of an annular shape. After assembly of the upstream housing 85*a* and the downstream housing 85*b*, the protrusion portion 85*bp* of an annular shape is loosely fit into the first recessed groove 82*a* of an annular shape.

Further, in a state where the upstream housing 85*a* and the downstream housing 85*b* have been assembled, the flow cross-sectional area of the intake channel 21 is connected smoothly without a change.

In this state, a space formed radially outside the protrusion portion 85*bp* of an annular shape is the first recessed groove 82*a* of an annular shape, and a space formed radially inside the protrusion portion 85*bp* of an annular shape (adjacent to the intake channel 21) is the upstream opening 83 of an annular shape.

Further, the first recessed groove 82*a* communicates with the circulation hole 82*b* of the downstream housing 85*b*.

Thus, the recirculation channel 82 includes the circulation hole 82*b* (see FIG. 3) of an ellipse shape disposed along the circumferential direction of the intake channel 21 of the downstream housing 85*b*, the first recessed groove 82*a* of an annular shape communicating with the circulation hole 82*b* along the circumferential direction of the intake channel 21 of the upstream housing 85*a*, and the upstream opening 83 of an annular shape communicating with the first recessed groove 82*a* of an annular shape.

Figure 9:
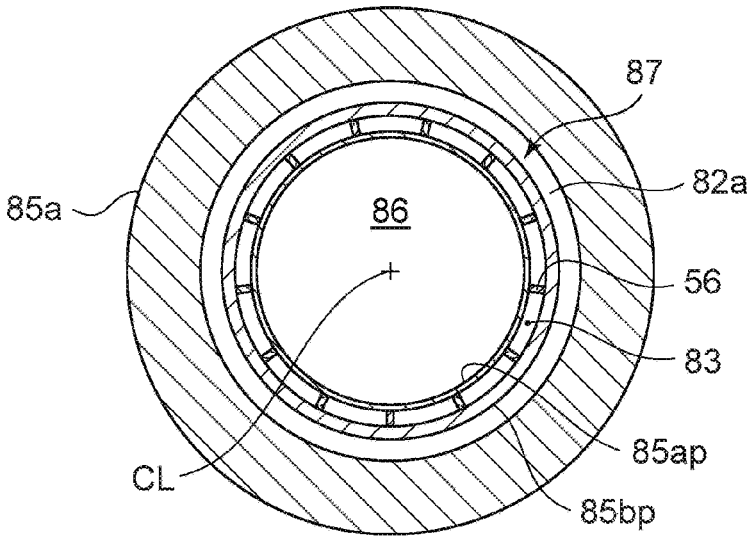
FIG. 9 is a cross-sectional view taken along line A-A from FIG. 8.
Figure 10:
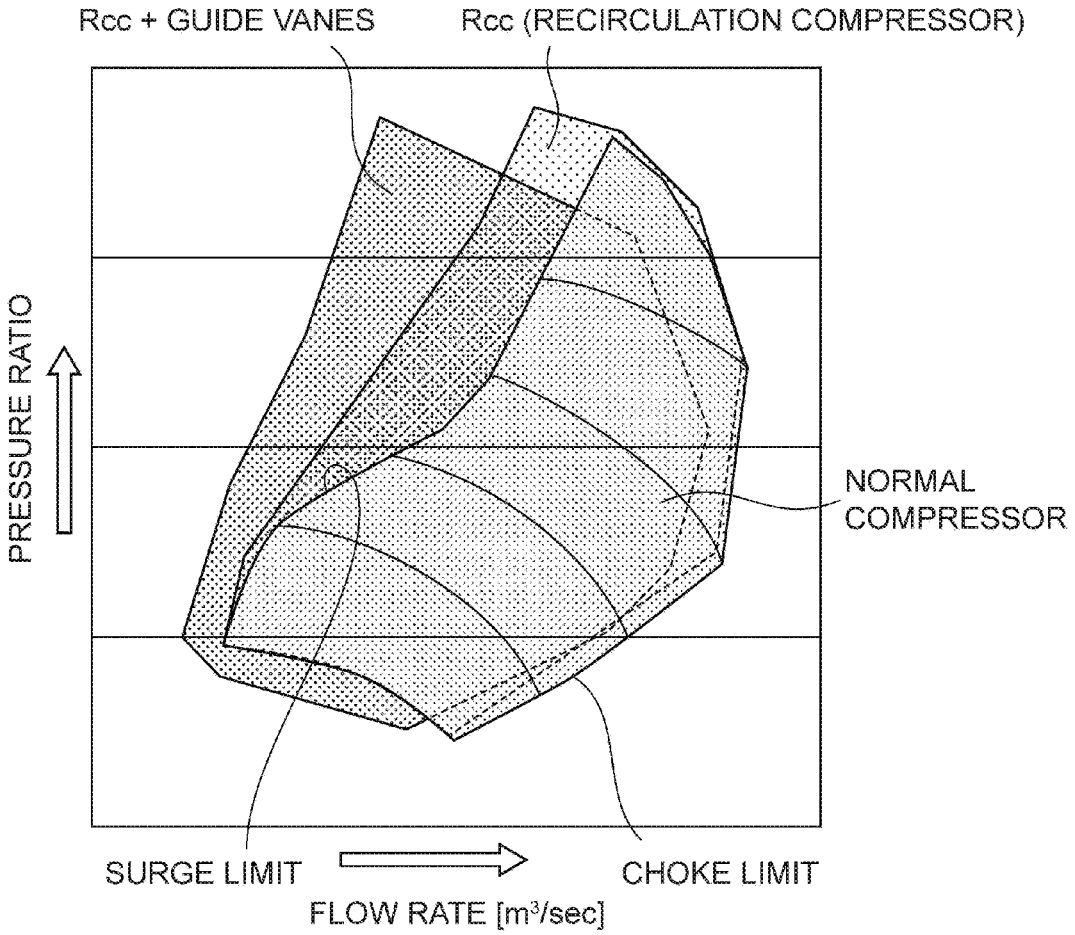
FIG. 10 is a comparison diagram of general performance characteristics of a centrifugal compressor.
Figure 11:
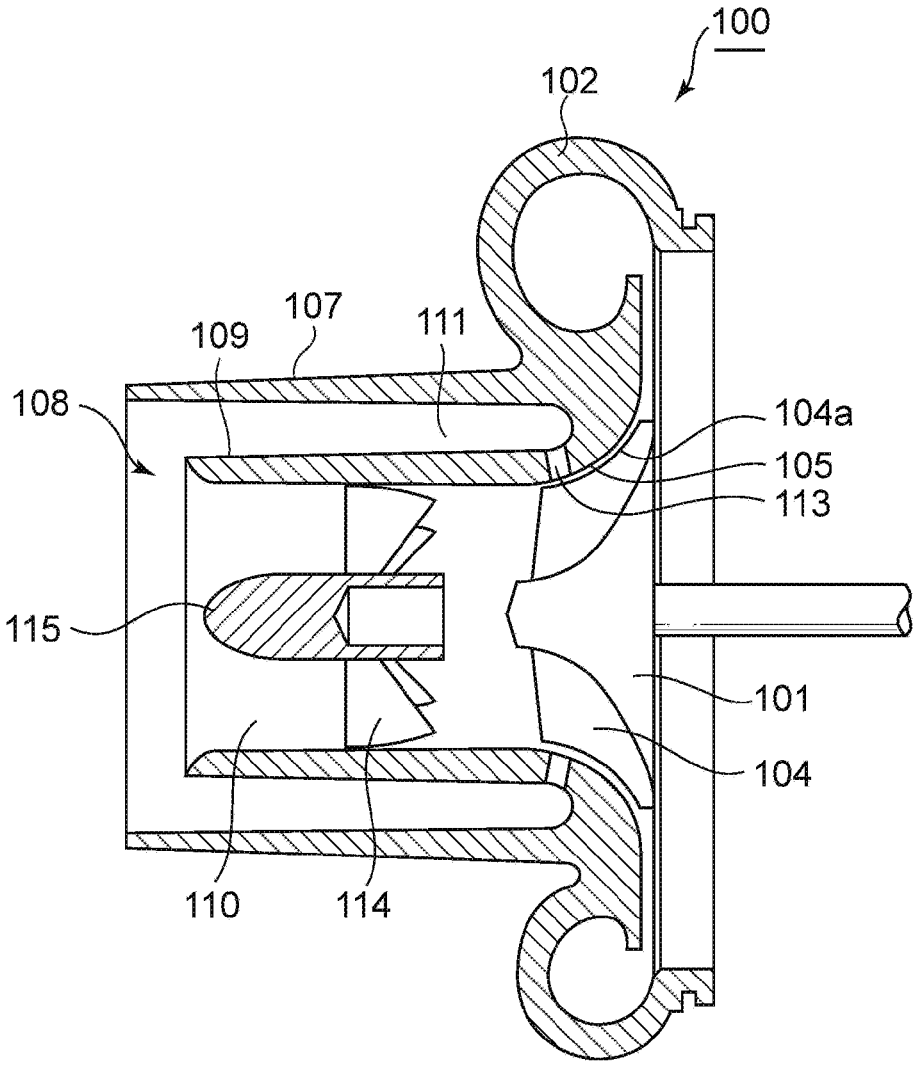
FIG.11 RELATED ART
FIG. 11 is an explanatory cross-sectional view of a centrifugal compressor of a conventional technique.

FIG. 9 illustrates a cross section of the first recessed groove 82*a* of the upstream housing 85*a* in a direction orthogonal to the rotational axis CL, which is the A-A cross section from FIG. 8.

The central intake-air flowing section 86 is formed at the center as an interior space of the upstream partition wall portion 85*ap* of an annular shape.

The upstream opening 83 of an annular shape is a gap formed by the outer circumferential surface of the upstream partition wall portion 85*ap* and the inner circumferential surface of the protrusion portion 85*bp* of an annular shape. Further, guide vanes 56 are disposed in the upstream opening 83 in the radial direction about the rotational axis CL, and at regular intervals in the circumferential direction.

The first recessed groove 82*a* is formed by the inner circumferential surface of the protrusion portion 85*bp* of an annular shape and a wall surface of the upstream housing 85*a* that is forming the first recessed groove.

Further, the upstream housing 85*a* includes intake-air introducing holes 89 on a radially outer part of the intake channel 21 at a position facing the upstream opening 83. The upstream opening 83 communicates with the intake port 23 via the intake-air introducing holes 89.

The intake-air introducing holes 89 are arranged at regular intervals in the circumferential direction, centered at the rotational axis CL. Also, partition walls 85*ac* partitioning the adjacent intake-air introducing holes 85*ab* are arranged at the substantially same phase in the circumferential direction as the guide vanes 56.

The width in the circumferential direction of the partition walls 85*ac* is larger than the thickness of the guide vanes 56.

The parallel flow generating unit 81 includes a parallel flow generating part 87 and a central intake-air flowing section 86.

The parallel flow generating part 87 includes the radially inner surface of the protrusion portion 85*bp* of an annular shape, the radially outer surface of the upstream partition wall portion 85*ap*, the upstream opening 83 of an annular shape formed by the above, and the guide vanes 56 whose guide surfaces are arranged parallel to the direction of the rotational axis CL inside the upstream opening 83.

Further, the guide vanes 56 are formed integrally on the radially inner surface of the protrusion portion 85*bp* of an annular shape or the radially outer surface of the upstream partition wall portion 85*ap*.

The central intake-air flowing section 86 is a cylindrical space section formed by the radially inner surface of the upstream partition wall portion 85*ap*, having an opening in the direction of the rotational axis CL.

Thus, if the amount of intake air is small (the surge flow rate), the intake air (recirculation intake air) flows through the downstream opening 43, the circulation holes 82*b*, the first recessed groove 82*a* of an annular shape, the gap F between the upstream tip end of the protrusion portion 85*bp* and the upstream tip end of the first recessed groove 82*a*, between the guide vanes 56 disposed on the upstream opening 83, and into the intake channel 21.

On the other hand, the intake air from the intake port 23 is introduced into the intake-air introducing holes 85*ab*, passes through the guide vanes 56 while drawing the recirculation intake air out from the upstream opening 83, and flows out into the intake channel 21.

With the thickness of the protrusion portion 85*bp* in the radial direction being reduced, the cross-sectional area of the intake-air flow path in the first recessed groove 82*a* of an annular shape and the upstream opening 83 is increased. Also, the tapered portion with an increased diameter makes it easy for the intake air to be drawn into the intake channel 21 by the intake air flowing through the intake channel 21 and prevents turbulence in the rectified intake flow.

The intake air having flown through the guide vanes 56 and rectified to be parallel to the rotation shaft 9 is introduced to the outer circumferential part of the upstream edges of the impellers 31 smoothly by the tapered portion with an increased diameter oriented toward the position E of the downstream housing 85*b*.

Further, the intake air from the upstream opening 83 is drawn out by the intake air introduced into the intake-air introducing holes 85*ab*. Thus, the surge flow rate (minimum flow rate) further decreases and the surge margin improves.

Further, since the guide vanes 56 are disposed in the recirculation channel 82 (in a gap between the upstream partition wall portion 85*ap* and the protrusion portion 85*bp*), it is possible to make the amount of protrusion toward the intake channel 21 small, i.e., it is possible to secure a large cross-sectional area of the flow path of the intake air in the central intake-air flowing section 66.

As a result, the flow rate of the intake air flowing through the intake channel 21 increases, which makes it possible to increase the choke flow rate.

As described above, the recirculation channel 41 is halved into the section of the upstream housing 85*a* and the section of the downstream housing 85*b*. Thus, it is possible to process the circulation holes 82*a*, 82*b* of the recirculation channel 82 and the guide vanes 56 from the division surfaces of the upstream housing 85*a* and the downstream housing 85*b*, respectively.

In this way, formation of the recirculation channel 82 is facilitated, which makes it possible to reduce the man hours.

The positions of the circulation holes 82*b* of the downstream housing 85*b* and the circulation holes 82*a* of the upstream housing 85*a* are formed so as to match in both of the radial direction and the circumferential direction, so that the circulation holes 41*a*, 41*b* merge by joining the respective housings.

INDUSTRIAL APPLICABILITY

The present invention relates to a centrifugal compressor including an impeller wheel rotated by a rotation shaft, and can be suitably applied to a centrifugal compressor to be incorporated into an exhaust turbocharger 1.

DESCRIPTION OF REFERENCE NUMERALS

1 Turbocharger
7 Impeller wheel
9 Rotation shaft
15, 85 Compressor housing (housing)
15*a*, 85*a* Upstream housing
15*b*, 85*b* Downstream housing
19, 20, 70, 80 Compressor (centrifugal compressor)
21 Intake channel
23 Intake port
31 Impeller
33 Shroud portion
41, 82 Recirculation channel
41*a*, 82*a* First recessed groove
41*b*, 82*b* Circulation hole (second recessed groove)
43 Downstream opening
45, 83 Upstream opening (recirculation port)
52, 62, 72, 87 Parallel flow generating part
53 Outer tubular member
55, 56 Guide vane
59, 63, 86 Central intake-air flowing section
51, 61, 71, 81 Parallel flow generating unit
65 Inner tubular member (annular guide portion)
73 Connection member
73*a* Through hole
73*b* Connecting portion
85*ab* Intake-air introducing hole
85*ac* Partition wall
85*ap* Upstream partition wall portion
85*bp* Annular protrusion portion (second partition wall)
CL Rotational axis

The invention claimed is:

1. A centrifugal compressor comprising:

a housing including an intake port having an opening in a direction of a rotation shaft of the centrifugal compressor and an intake channel connecting to the intake port;

an impeller wheel disposed inside the housing so as to be rotatable about the rotation shaft and configured to compress intake air flowing in via the intake port;

a parallel flow generating unit disposed between the intake port and the impeller wheel and configured to rectify the intake air flowing in via the intake port to be parallel to the direction of the rotation shaft; and a recirculation channel through which an outer circumferential section of the impeller wheel communicates with a recirculation port disposed on the intake channel at an upstream side of the impeller wheel, wherein the parallel flow generating unit includes a parallel flow generating part including a plurality of guide vanes arranged in a circumferential direction along an inner circumferential wall of the housing, each of the plurality of guide vanes arranged unrotatably with respect to the inner circumferential wall and parallel to a direction of a rotational axis of the rotation shaft, the parallel flow generating part being configured to rectify the intake air flowing in via the intake port to be parallel to the direction of the rotation shaft by the guide vanes, and a central intake-air flowing section which is a space surrounded by the parallel flow generating part and which has an opening in the direction of the rotation shaft so that the intake air flowing in via the intake port flows through the opening, and wherein an intake-air outflow direction from the recirculation port is such a direction that the intake air intersects with the direction of the rotation shaft and that at least a part of the intake air intersects with upstream edges of the guide vanes, wherein a wall surface of the recirculation port on the intake-port side is inclined toward the parallel flow generating part as seen from a direction orthogonal to the direction of the rotation shaft.

2. The centrifugal compressor according to claim 1, wherein the recirculation port is disposed at an intermediate position, in the circumferential direction, between the guide vanes arranged at intervals in a circumferential direction of the intake channel.

3. The centrifugal compressor according to claim 1, wherein the central intake-air flowing section includes an annular guide portion connecting inner circumferential edges of the guide vanes in the circumferential direction.

4. The centrifugal compressor according to claim 3, wherein a rim of the annular guide portion adjacent to the impeller wheel protrudes toward the impeller wheel from edges of the guide vanes adjacent to the impeller wheel.

5. The centrifugal compressor according to claim 3, wherein the parallel flow generating unit includes an annular casing including the recirculation port and constituting a part of the recirculation channel, the annular guide portion, the guide vanes, and a connecting portion coupled to an upstream side of the recirculation port at one end and coupled to an upstream rim of the annular guide portion at another end, wherein the annular casing, the annular guide portion, the guide vanes, and the connecting portion are formed integrally as a single piece.

6. The centrifugal compressor according to claim 1, wherein the recirculation channel is partitioned in the circumferential direction of the intake channel by partition walls extending along the direction of the rotation shaft.

7. The centrifugal compressor according to claim 1, wherein the guide vanes are formed in a trapezoidal shape so that a length of the guide vanes along the direction of the rotation shaft decreases from an inner circumferential surface of the intake channel toward the rotational axis.

8. The centrifugal compressor according to claim 1, wherein edges of the guide vanes adjacent to the rotational axis are disposed on a side adjacent to the rotational axis with respect to an outer circumference of an upstream edge of the impeller wheel.

9. The centrifugal compressor according to claim 1, wherein the housing is divided into an upstream housing including the intake channel and a downstream housing accommodating the impeller wheel, wherein the centrifugal compressor further comprises:

a first partition wall disposed on the upstream housing so as to define the intake channel and form a first recessed groove on a contact surface to the downstream housing at a radially outer side of the first partition wall, the first recessed groove having an annular shape centered at the rotation shaft and extending toward an upstream side of the intake channel; and a second partition wall which is a portion of the downstream housing facing the first recessed groove, the second partition wall defining the intake channel and forming a second recessed groove arranged in an annular shape centered at the rotation shaft, the second recessed groove extending toward a downstream side of the intake channel and having a communication hole communicating with the outer circumferential section of the impeller wheel, the second partition wall having a protrusion portion of an annular shape loosely fit into the first recessed groove and disposed so as to have a gap on a radially outer surface and a radially inner surface from the first recessed groove, wherein the guide vanes are disposed in the gap between the first partition wall and the second partition wall, and wherein the intake air flowing in via the communication hole flows through the second recessed groove, a gap between the first recessed groove and a radially outer side of the second partition wall, and a gap between a radially inner side of the second partition wall and a radially outer side of the first partition wall in this order, is rectified by the guide vanes to be parallel to the direction of the rotation shaft, and flows out to the intake channel toward the impeller wheel.

10. A centrifugal compressor comprising:

a housing including an intake port having an opening in a direction of a rotation shaft of the centrifugal compressor and an intake channel connecting to the intake port:

an impeller wheel disposed inside the housing so as to be rotatable about the rotation shaft and configured to compress intake air flowing in via the intake port;

a parallel flow generating unit disposed between the intake port and the impeller wheel and configured to rectify the intake air flowing in via the intake port to be parallel to the direction of the rotation shaft; and a recirculation channel through which an outer circumferential section of the impeller wheel communicates with a recirculation port disposed on the intake channel at an upstream side of the impeller wheel, wherein the parallel flow generating unit includes a parallel flow generating part including, a plurality of guide vanes arranged in a circumferential direction along an inner circumferential wall of the housing, the parallel flow generating part being configured to rectify the intake air flowing in via the intake port to be parallel to the direction of the rotation shaft by the guide vanes, and a central intake-air flowing section which is a space surrounded by the parallel flow generating part and which has an opening in the direction of the rotation shaft so that the intake air flowing in via the intake port flows through the opening, wherein an intake-air outflow direction from the recirculation port is oriented in a direction toward the parallel flow generating part as seen from a direction orthogonal to the direction of the rotation shaft, and wherein the recirculation port is disposed at an intermediate position, in the circumferential direction, between the guide vanes arranged at intervals in a circumferential direction of the intake channel.

11. A centrifugal compressor comprising:

a housing including, an intake port having an opening in a direction of a rotation shaft of the centrifugal compressor and an intake channel connecting to the intake port;

an impeller wheel disposed inside the housing so as to be rotatable about the rotation shaft and configured to compress intake air flowing in via the intake port;

a parallel flow generating unit disposed between the intake port and the impeller wheel and configured to rectify the intake air flowing in via the intake port to be parallel to the direction of the rotation shaft; and a recirculation channel through which an outer circumferential section of the impeller wheel communicates with a recirculation port disposed on the intake channel at an upstream side of the impeller wheel, wherein the parallel flow generating unit includes a parallel flow generating part including a plurality of guide vanes arranged in a circumferential direction along an inner circumferential wall of the housing, the parallel flow generating part being configured to rectify the intake air flowing in via the intake port to be parallel to the direction of the rotation shaft by the guide vanes, and a central intake-air flowing section which is a space surrounded by the parallel flow generating part and which has an opening in the direction of the rotation shaft so that the intake air flowing in via the intake port flows through the opening, wherein an intake-air outflow direction from the recirculation port is oriented in a direction toward the parallel flow generating part as seen from a direction orthogonal to the direction of the rotation shaft, wherein the central intake-air flowing section includes an annular guide portion connecting inner circumferential edges of the guide vanes in the circumferential direction, wherein the parallel flow generating unit includes an annular casing including the recirculation port and constituting a part of the recirculation channel, the annular guide portion, the guide vanes, and a connecting portion coupled to an upstream side of the recirculation port at one end and coupled to an upstream rim of the annular guide portion at another end, and wherein the annular casing, the annular guide portion, the guide vanes, and the connecting portion are formed integrally to a single piece.

12. A centrifugal compressor comprising:

a housing including an intake port having an opening in a direction of a rotation shaft of the centrifugal compressor and an intake channel connecting to the intake port;

an impeller wheel disposed inside the housing so as to be rotatable about the rotation shaft and configured to compress intake air flowing in via the intake port;

a parallel flow generating unit disposed between the intake port and the impeller wheel and configured to rectify the intake air flowing in via the intake port to be parallel to the direction of the rotation shat; and a recirculation channel through which an outer circumferential section of the impeller wheel communicates with a recirculation port disposed on the intake channel at an upstream side of the impeller wheel, wherein the parallel flow generating unit includes a parallel flow generating part including a plurality of guide vanes arranged in a circumferential direction along an inner circumferential wall of the housing, the parallel flow generating part being configured to rectify the intake air flowing in via the intake port to be parallel to the direction of the rotation shaft by the guide vanes, and a central intake-air flowing section which is a space surrounded by the parallel flow generating part and which has an opening in the direction of the rotation shaft so that the intake air flowing in via the intake port flows through the opening, wherein an intake-air outflow direction from the recirculation port is oriented in a direction toward the parallel flow generating part as seen from a direction orthogonal to the direction of the rotation shaft, wherein the housing is divided into an upstream housing including the intake channel and a downstream housing accommodating the impeller wheel, wherein the centrifugal compressor further comprises:

a first partition wall disposed on the upstream housing so as to define the intake channel and form a first recessed groove on a contact surface to the downstream housing at a radially outer side of the first partition wall, the first recessed groove having an annular shape centered at the rotation shaft and extending toward an upstream side of the intake channel; and a second partition wall which is a portion of the downstream housing facing the first recessed groove, the second partition wall defining the intake channel and forming a second recessed groove arranged in an annular shape centered at the rotation shaft, the second recessed groove extending toward a downstream side of the intake channel and having a communication hole communicating with the outer circumferential section of the impeller wheel, the second partition wall having a protrusion portion of an annular shape loosely fit into the first recessed groove and disposed so as to have a gap on a radially outer surface and a radially inner surface from the first recessed groove, wherein the guide vanes are disposed in the gap between the first partition wall and the second partition wall, and wherein the intake air flowing in via the communication hole flows through the second recessed groove, a gap between the first recessed groove and a radially outer side of the second partition wall, and a gap between a radially inner side of the second partition wall and a radially outer side of the first partition wall in this order, is rectified by the guide vanes to be parallel to the direction of the rotation shaft, and flows out to the intake channel toward the impeller wheel.

* * * * *